US005734404A

United States Patent [19]

Komuro et al.

[11] Patent Number: 5,734,404

[45] Date of Patent: Mar. 31, 1998

[54] PRINTER FOR FEEDING CURLED SHEETS

[75] Inventors: Kiyoto Komuro; Takashi Akahane; Shigeki Hayashi, all of Nagano, Japan

[73] Assignee: Seiko Epson Corporation, Tokyo, Japan

[21] Appl. No.: 652,257

[22] Filed: May 23, 1996

[30] Foreign Application Priority Data

Jun. 9, 1995 [JP] Japan ..... 7-167926

[51] Int. Cl.[6] ..... B41J 2/01

[52] U.S. Cl. ..... 347/104; 271/272; 271/275; 400/642

[58] Field of Search ..... 347/101, 104; 226/4, 32, 81; 271/225, 226, 272, 273, 275; 355/317; 400/579, 613.1, 617, 619, 642

[56] References Cited

U.S. PATENT DOCUMENTS

| | | | |
|---|---|---|---|
| 5,466,079 | 11/1995 | Quintana | 400/579 |
| 5,527,123 | 6/1996 | Jackson et al. | 400/642 |

FOREIGN PATENT DOCUMENTS

| | | |
|---|---|---|
| 0 496 987 | 8/1992 | European Pat. Off. . |
| 2 384 623 | 10/1978 | France . |
| 61-37451 | 2/1986 | Japan . |
| 61-34548 | 3/1986 | Japan . |
| 61-164870 | 7/1986 | Japan . |

*Primary Examiner*—Benjamin R. Fuller
*Assistant Examiner*—Juanita Stephens
*Attorney, Agent, or Firm*—Stroock & Stroock & Lavan LLP

[57] ABSTRACT

Generally speaking, in accordance with the invention, a printer is provided for consistently printing on a sheet of recording media regardless of any curl in the recording media. The printer includes a feed roller for feeding a sheet of recording medium through the printer. At least one pinch roller is provided for pressing the sheet against the feed roller. At least one guide is provided with an end which contacts the feed roller in the vicinity of the contact point so as to guide the sheet toward the contact point. A biasing member is provided for biasing the end of the guide against the feed roller, and at least one control roller is rotatably attached to the guide to control the contact force exerted by the end of the guide against the feed roller.

8 Claims, 8 Drawing Sheets

PRINTER FOR FEEDING CURLED SHEETS

BACKGROUND OF THE INVENTION

1. Field of the Invention

This invention relates generally to a printer, and more particularly to a printer which feeds a printing sheet to a desired print start position on the printing sheet even if the sheet is curled.

2. Related Art

A conventional printer, such as that described in Japanese Utility Model Unexamined Disclosure No. Sho 61-34548 and as shown in FIGS. 8 and 9, includes a platen 1, about the outer circumference of which are located print heads which face the platen (not shown). A paper pan 2 extends adjacent the lower portion of platen 1 and has an extended portion 2*a*. A first pinch roller 3*a* and a second pinch roller 3*b* are pressed against platen 1 through openings in paper pan 2. A guide member 4 is disposed on the upstream side of platen 1 along the sheet feed path.

A conventional printer as described above operates as follows. A rotating feed roller of a sheet feeding device (not shown) engages a printing sheet P. As shown in FIG. 8, as platen 1 and pinch roller 3*a* are rotating in the respective directions indicated by arrows D and E, printing sheet P is fed toward a point where platen 1 and pinch roller 3*a* contact each other. When a leading end Pa of printing sheet P is passed through the point of contact of platen 1 and pinch roller 3*a* and has traveled beyond this point a distance a, a=10 mm to 15 mm as shown, the feed roller (not shown) is halted. As shown in FIG. 9, platen 1 and pinch roller 3*a* are rotated in reverse (that is, in the respective directions indicated by arrows F and G) to move the leading end Pa of the sheet backward (that is, in the opposite direction to that in which it was originally fed). As a result the leading end Pa of the sheet is aligned widthwise along the point of contact of platen 1 and pinch roller 3*a*. In this position, extended portion 2*a* of paper pan 2 provides sufficient resistance to printing sheet P to prevent printing sheet P from being moved backward too far. Platen 1 and pinch roller 3*a* are then rotated in the respective directions of the arrows of FIG. 8 to feed printing sheet P forward. When the desired print start position on printing sheet P reaches the location where printing occurs ("the printing location"), the feeding process is terminated.

The above construction is satisfactory where printing sheet P is flat and does not tend to stick to platen 1. However, where printing sheet P is curled and therefore tends to stick to platen 1 as shown in FIG. 10, difficulties may result. When leading end Pa of printing sheet P is passed in reverse through the point of contact of platen 1 and pinch roller 3*a*, leading end Pa may be strongly held in contact with platen 1 due to the curling of printing sheet P or its tendency to stick to platen 1. As a result, whereas leading end Pa should normally abut the point of contact of platen 1 and pinch roller 3*a*, printing sheet P will instead continue to follow the reverse direction of platen 1 and will be fed too far in reverse. Thus, when platen 1 and pinch roller 3*a* are thereafter rotated to feed printing sheet P forward to match the print start position of printing sheet P with printing location, the distance that printing sheet P is fed forward will be reduced by the distance which leading end Pa was fed too far in reverse. Consequently, the desired print start position on printing sheet P will not be matched with the printing location and printing will begin above the desired print start position (that is, a "leading error" will occur). This problem is especially acute when stiff printing sheets are used because a curled leading end of such a sheet will have a greater tendency to stick to platen 1.

As shown in FIG. 10, this problem (i.e. the problem that occurs when leading end Pa of sheet P is fed too far in reverse when platen 1 and pinch roller 3*a* are rotated in reverse) can be resolved by employing a guide 4 with an end 4*a* which is located so that end 4*a* contacts platen 1 and is as close as possible to the point of contact between platen 1 and pinch roller 3*a*, so that leading end Pa of sheet P is prevented from sticking to, or is separated from, platen 1 when platen 1 rotates in reverse. Further, with this structure, an effect can be obtained that leading end Pa of the sheet P can be guided more smoothly toward the point of contact between platen 1 and pinch roller 3*a*.

When the end 4*a* of the guide 4 is in contact with platen 1, however, the force with which it is held against platen 1 varies due to discrepancies in the manufacture of the guide 4 and the platen 1. Therefore, another problem that occurs is that as the contact force between end 4*a* and platen 1 is increased, end 4*a* of guide 4 causes increased abrasion of platen 1. As a result, platen 1 may not rotate smoothly. In particular, when platen 1 is rotated in reverse, end 4*a* of guide 4 will act on platen 1 in the direction in which it contacts platen 1, and platen 1 will not rotate smoothly.

Accordingly, it is desired to provide a printer which feeds both flat and curled printing sheets so that printing begins at the desired print start position on each printing sheet.

SUMMARY OF THE INVENTION

Generally speaking, in accordance with the invention, a printer is provided for consistently printing on a sheet of recording media regardless of any curl in the recording media. The printer includes a feed roller for feeding a recording medium through the printer. At least one pinch roller is provided for pressing the sheet against the feed roller. At least one guide is provided with an end which contacts the feed roller in the vicinity of the contact point between the feed roller and the pinch roller so as to guide the sheet toward the point of contact. A biasing member is provided for biasing the end of the guide against the feed roller, and at least one control roller is rotatably attached to the guide to control the contact force exerted by the end of the recording medium guide against the feed roller.

Accordingly, it is an object of this invention to provide a printer which can guide a sheet more smoothly.

Another object of this invention is to provide a printer which begins printing at a desired print start position on a printing sheet regardless of a curl in the printing sheet.

A further object of this invention is to provide a printer which prevents a printing sheet from sticking to a feed roller when the feed roller is rotated in reverse.

A still further object of this invention is to provide a printer with a sheet guide which minimizes abrasion of a feed roller.

Still other objects and advantages of the invention will in part be obvious and will in part be apparent from the specifications and drawings.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
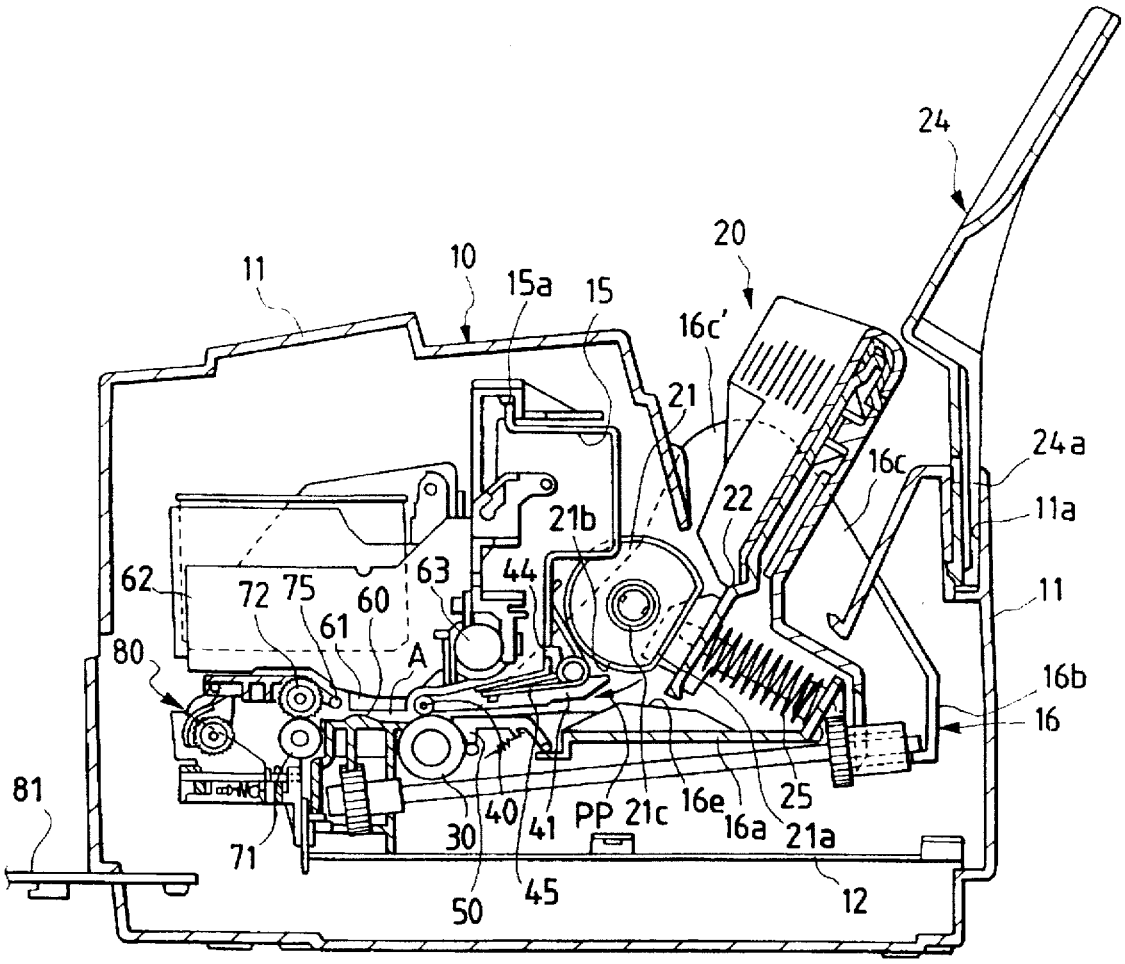
FIG. 1 is a cross-sectional side elevational view of the internal structure of an ink jet printer constructed in accordance with the present invention.

Referring now to FIG. 1, a printer main body generally indicated at 10, and constructed in accordance with the preferred embodiment of the invention, is provided. Printer main body 10 includes a printer main body case 11 and an automatic sheet feeder 20 disposed in printer main body 10. At least one feed roller 30 is mounted within printer main body 10 downstream of automatic sheet feeder 20 along a sheet feed path PP. At least one pinch roller 40 is pressed against the sheet feeding roller 30 and is driven by sheet feeding roller 30. At least one sheet guide 50 adapted to guide a printing sheet P of a suitable recording medium toward the point of contact of rollers 30, 40 is disposed upstream of rollers 30, 40 along sheet feed path PP. A control member 60 adapted to guide the non-print face of printing sheet P is disposed downstream of rollers 30, 40 along sheet feed path PP. A carriage 62 mounted within case 11 supports at least one ink jet head 61 thereon from which ink droplets are ejected and deposited onto the printing sheet P. A guide roller 75 downstream of ink jet head 61 guides the sheet along sheet feed path PP. A pair of sheet discharging rollers 71 and 72 are disposed between guide roller 75 and a paper discharging portion 80. In front of printer main body 10, a sheet discharging tray 81 is provided on which discharged sheets are stacked.

A printing sheet P, supplied from the automatic sheet feeder 20, is conveyed to feed roller 30 along sheet feed path PP. Sheet feed path PP is curved and has a concave shape as a whole. The corners of printing sheet P are aligned by the at least one pinch roller 40. As the leading end of printing sheet P is fed by feed roller 30, the non-print face of printing sheet P is guided by contact with the top surface of control member 60. In this manner, the distance between the sheet and the at least one ink-jet head 61 is regulated, and ink is ejected and deposited on the print surface of the sheet through the at least one ink-jet head 61 in printing portion A. Printing sheet P then passes through discharge rollers 71 and 72 and sheet discharge portion 80 and is discharged to the discharge tray 81.

Figure 2:
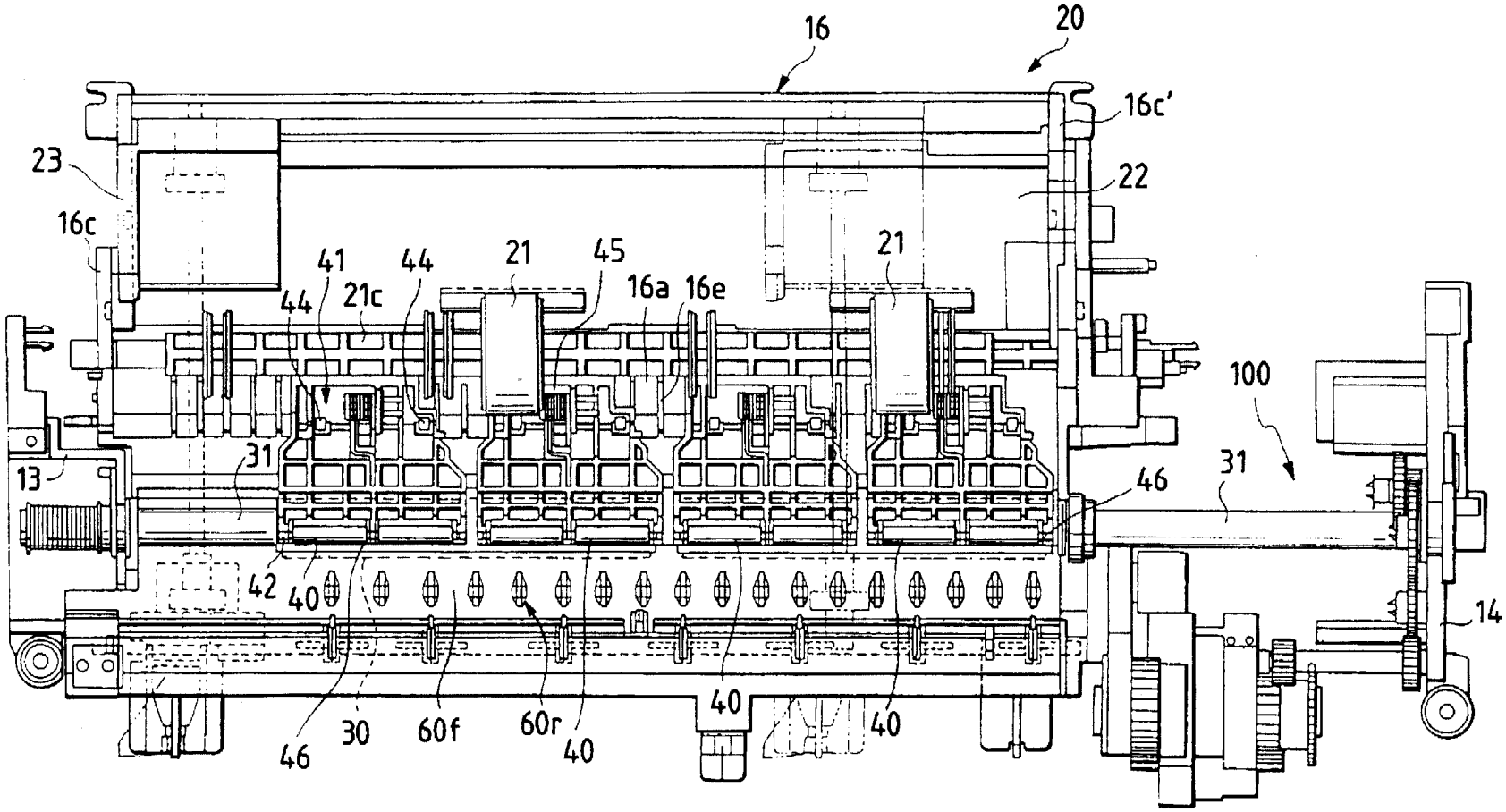
FIG. 2 is a top plan view showing certain components of the internal structure of an ink-jet printer constructed in accordance with the present invention.

As shown in FIGS. 1 and 2, printer main body 10 includes a bottom frame 12 within case 11 preferably made of a metal plate which also serves as a shield plate. Right and left side frames 13 and 14, preferably made of plastic, extend upward from bottom frame 12. An intermediate frame 15, preferably made of a metal plate, bridges the area between side frames 13 and 14. A sub-frame 16, preferably made of plastic, is secured to frames 13, 14 and 15 at several positions.

Figure 3:
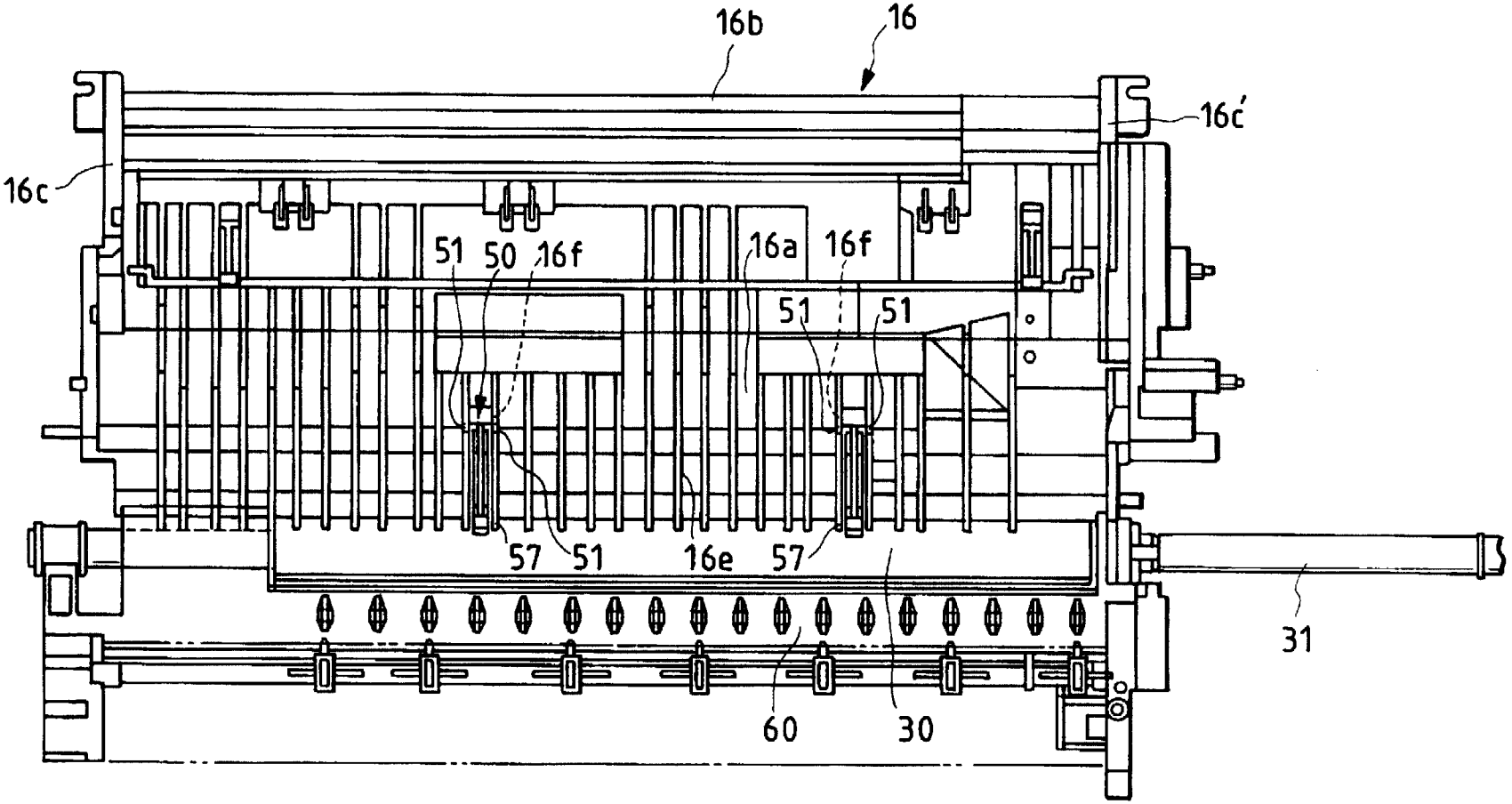
FIG. 3 is a top plan view of the sub-frame and printing sheet guides constructed in accordance with the present invention.
Figure 4:
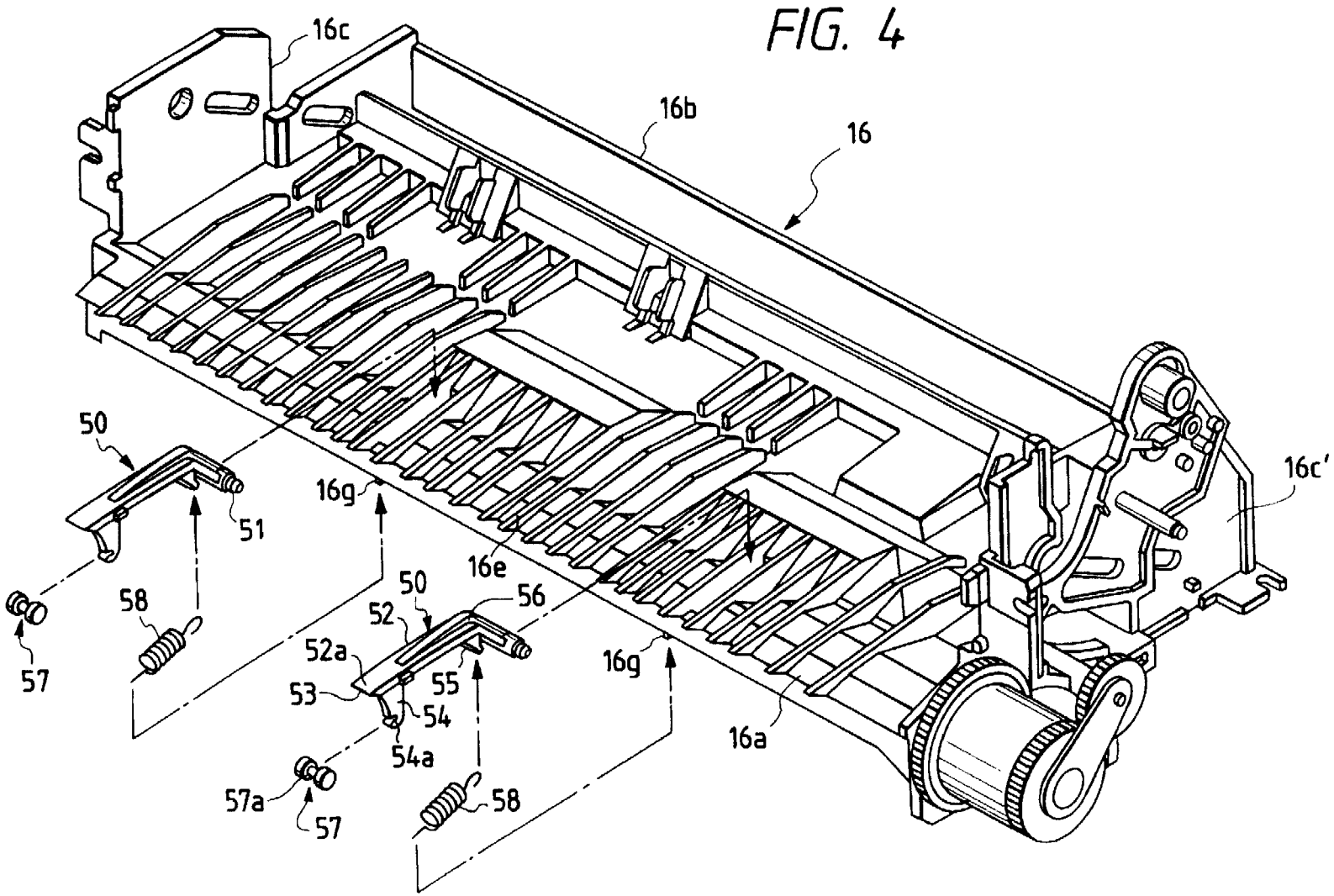
FIG. 4 is an exploded perspective view of the sub-frame and printing sheet guides constructed in accordance with the present invention.

As shown in FIGS. 3 and 4, sub-frame 16 includes a bottom plate **16*a* which forms the lower portion of sheet feed path PP, a back plate 16*b*, and side plates 16*c* and 16*c*' which are formed integrally with bottom plate 16*a* and back plate 16*b*. That is, bottom plate 16*a*, back plate 16*b*, and side plates 16*c* and 16*c*' are integrally formed. Sheet guide ribs 16*e* are formed on the top surface of bottom plate 16*a***.

As shown in FIGS. 1 and 2, automatic sheet feeder 20 includes a hopper 22, an edge guide 23 and a sheet tray 24. A supply roller shaft **21*c* with grooves is rotatably supported by side plates 16*c* and 16*c*' of sub-frame 16. Two sheet supply rollers 21 are fixedly mounted on supply roller shaft 21*c*. Each sheet supply roller 21 is substantially D-shaped in cross-section and has a linear portion 21*a* and an arc portion 21*b*, the surfaces of which are covered with a rubber layer. When a sheet is supplied, supply roller shaft 21*c* is rotated by a transmission mechanism (not shown) which operates in association with a drive mechanism 100**.

Hopper 22 is provided so that it can move diagonally upward and downward relative to sub-frame 16 (i.e. towards and away from supply rollers 21). A hopper spring 25 is provided to correspond to each supply roller 21 to bias hopper 22 diagonally and upward. A cam mechanism (not shown), which operates in association with drive mechanism 100, is mounted on side plates **16*c* and 16*c*' of sub-frame 16 to push hopper 22 down against the force exerted by hopper springs 25. Hopper 22 operates as follows to supply a printing sheet. Hopper 22 is released from its depressed position by the cam mechanism (not shown) so that hopper springs 25 push hopper 22 and the sheet thereon toward the supply rollers 21, thereby pressing the sheet against the supply rollers 21. After the sheet has been supplied, hopper 22 is driven downwardly by the cam mechanism and is released from the supply rollers 21. Edge guide 23 is slidably coupled to hopper 22. Edge guide 23, as shown in FIG. 2, guides the left side (edge) of printing sheet P (not shown) set on hopper 22. The right side (edge) of printing sheet P is guided by the upper inner surface of the upper internal face of right side plate 16*c*' of sub-frame 16**.

As shown in FIG. 1, sheet tray 24 is detachably mounted on printer main body 10 by inserting a portion **24*a* of sheet tray 24 into a slot 11*a* formed in case 11. The installed sheet tray 24 cooperates with hopper 22 to support the bottom (non-print) surface of a printing sheet. Once printing sheets P are loaded, automatic sheet feeder 20 is ready for operation. Hopper 22 is released from the cam mechanism (not shown) and pushed upwardly so that only the top sheet on the hopper 22 of the stack of printing sheets, abutted against sheet supply rollers 21**, is delivered into sheet feed path PP.

Figure 5:
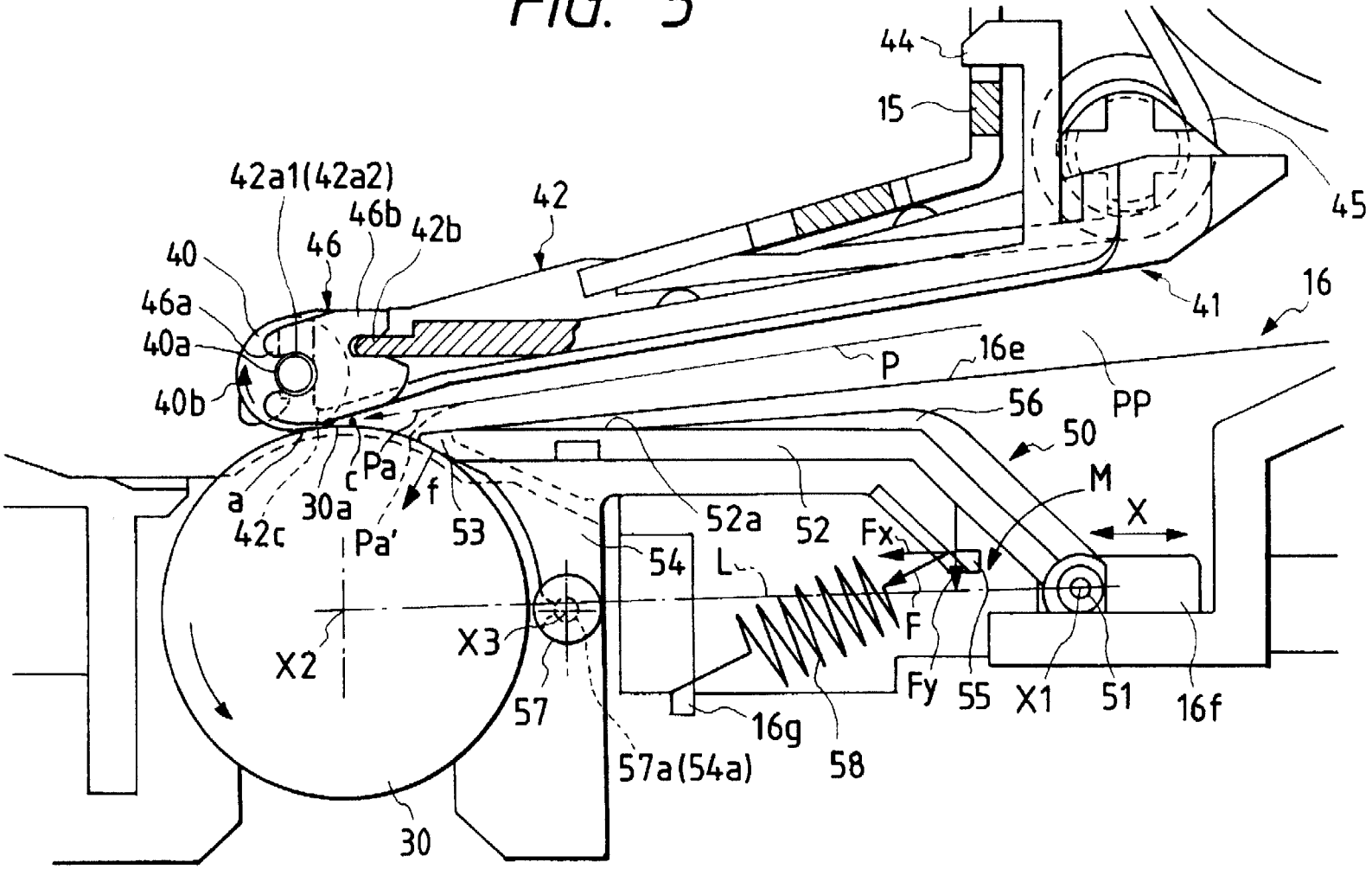
FIG. 5 is an enlarged cross-sectional elevational view of the printing sheet guides constructed in accordance with the present invention.
Figure 6:
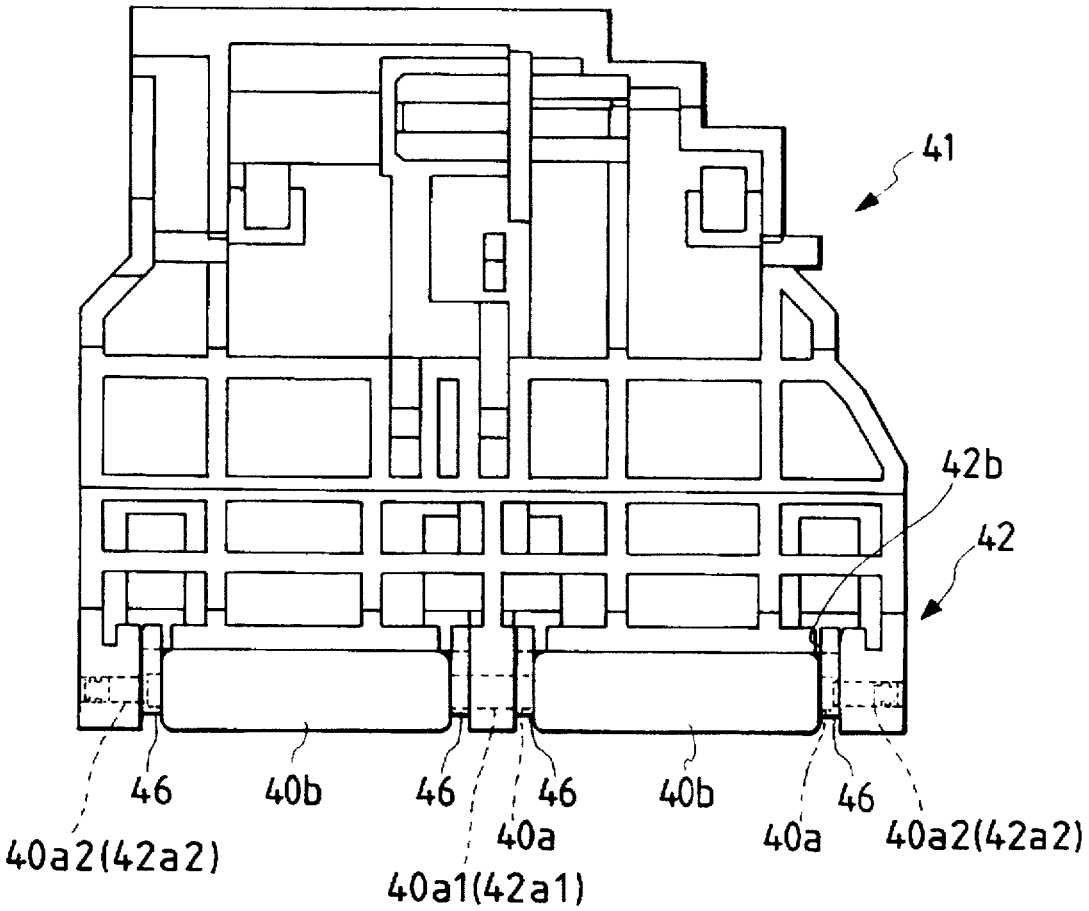
FIG. 6 is a plan view of the pinch rollers constructed in accordance with the present invention.
Figure 7A:
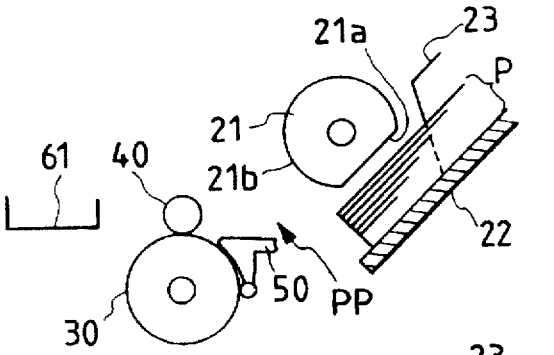
FIGS. 7(*a*)–7(*e*) depict the operation of a printer constructed in accordance with the present invention.
Figure 7B:
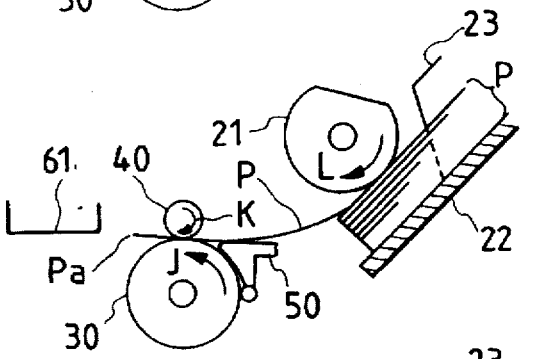
Figure 7C:
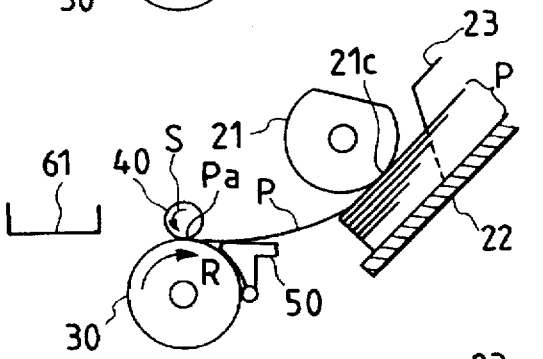
Figure 7D:
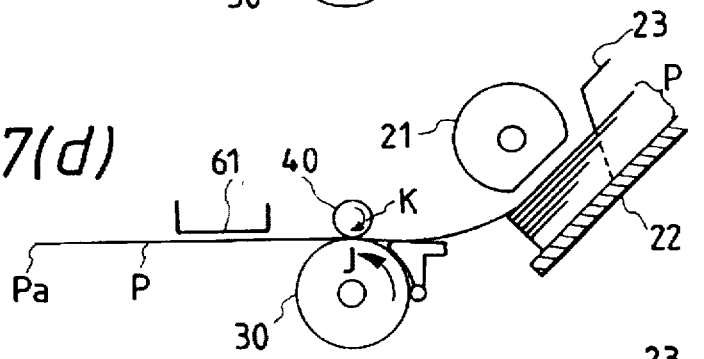
Figure 7E:
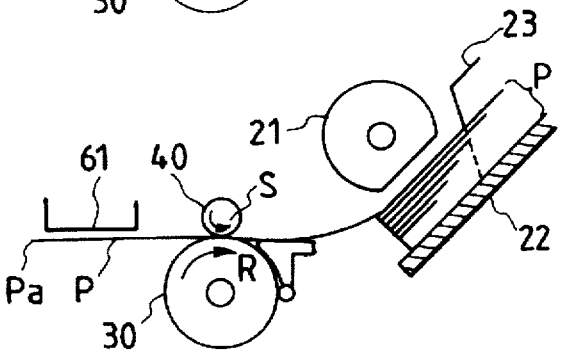
Figure 8:
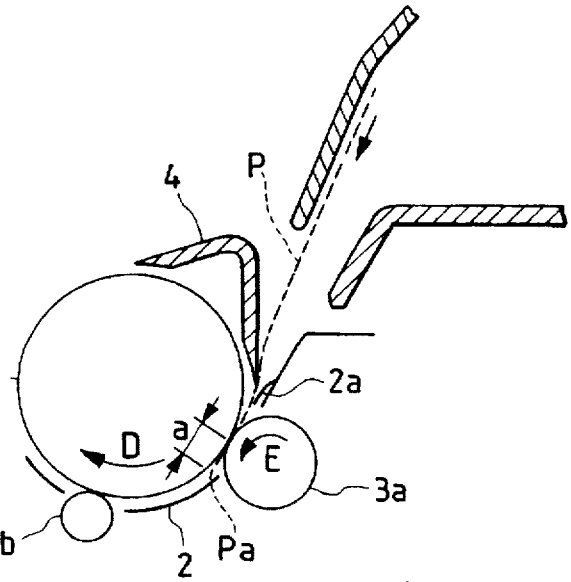
FIG. 8 PRIOR ART
FIG. 8 is a partial cross-sectional side elevational view of a printer constructed in accordance with the prior art.
Figure 9:
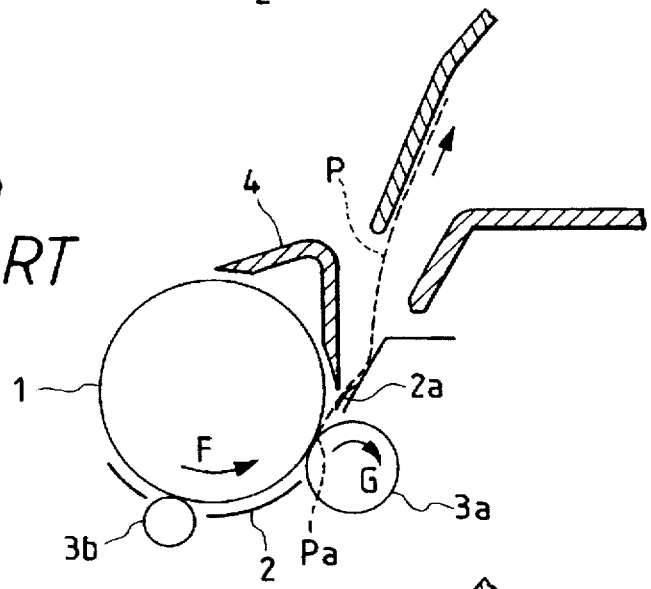
FIG. 9 PRIOR ART
FIG. 9 is a partial cross-sectional side elevational view of a printer constructed in accordance with the prior art.
Figure 10:
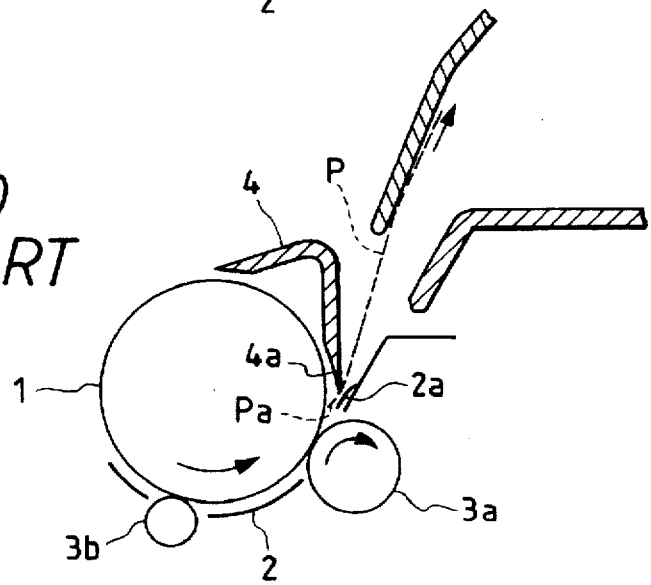
FIG. 10 PRIOR ART
FIG. 10 is a partial cross-sectional side elevational view of a printer constructed in accordance with the prior art.

As shown in FIGS. 2 and 3, feed roller 30 is constructed as a relatively long, rubber roller, having the shape of a round rod, and is fixedly mounted on feed roller shaft 31. Feed roller shaft 31 is supported by side frames 13 and 14, and is rotated by drive mechanism 100. During a printing operation, after ink-jet head 61 prints one line on the printing sheet P, feed roller 30 advances the printing sheet a distance that is the equivalent of one line of printing. Pinch roller 40 is a round rod-shaped roller formed of a material with a relatively high abrasion resistance, such as metal, for example. As shown in FIGS. 5 and 6, pinch roller 40 comprises a shaft 40*a* and two roller portions 40*b* integrally formed with shaft 40*a*. Shaft 40*a* includes a central portion 40*a*1 and end portions 40*a*2. However, although not shown, four pinch rollers 40 are preferably provided for feed roller 30. Pinch rollers 40 are rotatably supported as shown in FIGS. 5 and 6.

A holder 41 is formed with hooks 44 and is slidably mounted to intermediate frame 15. Holder 41 acts as a supporting member for rotatably supporting pinch rollers 40. Holder 41 also serves as a sheet guide, thus forming the upper portion of sheet feed path PP. Central portion 40*a*1 and both end portions 40*a*2 of shaft 40 of each pinch roller 40 are engaged with rectangular shaft reception holes 42*a*1 and 42*a*2 formed in the end portions of arms 42 of holder 41. Springs 45 are provided between holder 41 and intermediate frame 15.

The elastic force of spring 45 causes pinch roller 40 to abut against feed roller 30 at a position a (FIG. 5). Position a is located downstream of top 30*a* of feed roller 30 in the sheet feeding direction. That is, position a indicates a point where the pinch rollers 40 and feed roller 30 are pressed against each other. Holders 41 are made of a material such as synthetic resin which may not have a high abrasion resistance. Guide pieces 46 guide the leading end Pa of printing sheet P between feed roller 30 and pinch roller 40.

As shown in FIGS. 5 and 6, guide pieces 46 are independent of holders 41. Guide pieces 46 include corresponding respective engagement portions 46*a* which engage with corresponding shafts 40*a* of pinch rollers 40, and engaging portions 46*b* which engage with corresponding protrusions 42*b* extending from the end of arms 42. Guide pieces 46 are coupled to the end portions of arms 42 of holders 41 through engaging portions 46*a* and 46*b*. The engagement of portions 46*a* with shafts 40*a* of pinch rollers 40 determines the positioning of pinch roller 40 with respect to feed roller 30. As shown in FIG. 6, guide pieces 46 are positioned on each side of the roller portions 40*b* of pinch roller 40 (i.e. four guide members 46 per pinch roller 40).

As shown in FIGS. 3 through 5, each of the sheet guides 50 includes a shaft 51 and an arm 52 which is integrally formed with shaft 51. A roller support arm 54 is integrally formed and extends away from an end 53 of arm 52. A hook 55 is integrally formed adjacent arm 52 and is located between the roller support arm 54 and shaft 51. A rib 56 is formed on a top surface 52*a* of arm 52. A hook-shaped shaft reception hole 54*a* is formed in roller support arm 54 for rotatably receiving a control roller 57 mounted on a shaft 57*a*.

Sheet guides 50 are slidably and rotatably attached to sub-frame 16 by fitting the ends of the shafts 51 into long holes 16*f* formed in the bottom of sub-frame 16, so that shafts 51 slide freely. Sheet guides 50 are rotatably supported relative to the sub-frame 16 by shafts 51 which can move toward and away from feed roller 30 in a direction indicated by arrow X (FIG. 5). Tensile springs 58, which act as biasing members, are coupled between hooks 55 of sheet guides 50 and hooks 16*g* formed in sub-frame 16 to bias sheet guide 50 into contact with feed roller 30. Thus, sheet guides 50 are rotated counterclockwise in the direction of arrow M and are forced toward feed roller 30 by tensile springs 58 as shown in FIG. 5. Control rollers 57 are held in contact with feed roller 30 by tensile springs 58, and the ends 53 of arms 52 contact the feed roller 30 in the vicinity of the point a where feed roller 30 and pinch rollers 40 are pressed against each other. In other words, when control rollers 57 contact the feed roller 30, the ends 53 of the sheet guides 50 can be positioned relative to the feed roller 30, and the contact force can be controlled. The rotational axes X1 of shafts 51 of sheet guides 50, the rotational axis X2 of feed roller 30, and the rotational axes X3 of the control rollers 57 are placed substantially along a straight line L (it should be noted that in this embodiment, the rotational axes X3 of control rollers 57 are located slightly lower than line L).

In the above described arrangement, tensile springs 58 exert a force F on sheet guides 50 as shown in FIG. 5. A force component Fx of force F acts along line X toward feed roller 30 in the direction indicated by the vector Fx and is substantially offset by the abutment of control rollers 57 on feed roller 30. Thus, moment M, caused by a force component Fy of F which is perpendicular to the force component Fx, exerts a contact force f at the ends 53 of sheet guides 50 relative to feed roller 30. As a result, contact force f may be set to a small value to exert only a delicate force upon feed roller 30. It should be noted that two sheet guides 50 are used in this embodiment.

As shown in FIGS. 1 and 2, control member 60 is provided below the non-print side of the printing sheet fed by feed roller 30. The portion of control member 60 facing ink-jet heads 61 includes a horizontal portion 60*f* forming a flat portion, and integrally provided ribs 60*r* which protrude upward from horizontal portion 60*f*. Control member 60 is mounted to bottom frame 12. Carriage 62 is supported by a guide shaft 63 and an upper edge 15*a* of intermediate frame 15. Ink-jet heads 61 are attached to carriage 62, and a plurality of colored inks are ejected through the ink-jet heads 61 to perform color printing. Carriage 62 is driven by a carriage motor (not shown) and reciprocates along guide shaft 63 and upper edge 15*a* of intermediate frame 15 in a direction that is generally perpendicular to the surface of the drawing of FIG.1 (that is, generally perpendicular to sheet feed path PP).

Based on the above construction, the ink-jet printer operates as follows:

(a) In the standby state shown in FIG. 7(*a*), supply roller 21 is halted and its linear portion 21*a* faces a printing sheet P on the hopper 22.

(b) As shown in FIG. 7(*b*), when a sheet supply command signal is output by a controller (not shown) of the printer, feed roller 30 and pinch rollers 40 rotate in the directions of arrows J and K respectively in which a sheet is fed forward (that is, downstream along sheet feed path PP toward discharge portion 80), and supply roller 21 rotates in the direction of arrow L and feeds printing sheet P toward the pressure point a (FIG. 5) at which feed roller 30 and pinch rollers 40 are pressed against each other.

This feeding is performed until the leading end Pa of printing sheet P has passed a short distance through the pressure point a at feed roller 30 and pinch rollers 40. The ends 53 of paper guides 50 contact feed roller 30 in the vicinity of pressure point a of feed roller 30 and pinch roller 40. Thus, leading end Pa of printing sheet P is smoothly guided toward the pressure point a by paper guides 50. The ends 53 of paper guides 50 are also forced toward feed roller 30 by tensile springs 58, while the contact force f (FIG. 5) exerted by ends 53 on feed roller 30 is controlled by the control rollers 57. Therefore, even if the individual items have manufacturing defects, any variance due to these defects is reduced. Thus, abrasion caused by contact of the ends 53 of sheet guides 50 with feed roller 30 is prevented, and feed roller 30 can be smoothly rotated.

(c) As shown in FIG. 7(*c*), supply roller 21 is then halted, and feed roller 30 and pinch rollers 40 are rotated in reverse in the directions of arrows R and S respectively, thus feeding leading end Pa of printing sheet P in reverse. Even if printing sheet P is skewed as leading end Pa passes through the pressure point a of feed roller 30 and pinch rollers 40, when printing sheet P is fed in reverse, supply rollers 21 are pressed against printing sheet P at points 21*c* and resist movement of the trailing end of printing sheet P in the reverse direction. As a result, the leading end Pa is correctly aligned at the pressure point a of feed roller 30 and pinch rollers 40. That is, any skew of printing sheet P is removed.

Further, even if a leading end Pa' of printing sheet P is curled toward feed roller 30 as shown in FIG. 5, since the ends 53 of the sheet guides 50 contact feed roller 30 in the vicinity of pressure points a of feed roller 30 and pinch rollers 40, the leading end Pa' is prevented from sticking to feed roller 30 by separating leading end Pa' from feed roller 30 when feed roller 30 rotates in reverse.

(d) As shown in FIG. 7(*d*), supply rollers 21 and feed roller 30 next rotate forward in the directions of arrows J and K respectively until supply rollers 21 have completed exactly one rotation. Printing sheet P is then fed forward along sheet feed path PP an extra distance, and leading end Pa is passed beyond the position of ink-jet heads 61. It should be noted that supply rollers 21 are rotated exactly once by a one-rotation clutch, which is provided in a transmission mechanism (not shown) that cooperates with the above-described drive mechanism 100.

(e) As shown in FIG. 7(*e*), feed roller 30 is rotated in reverse in the direction of arrow R to determine the position of leading end Pa of printing sheet P relative to ink-jet heads 61. Once leading edge Pa is properly positioned relative to ink-jet heads 61, printing is begun on the print side of the sheet. As a result, the print start position on printing sheet P is not affected by a variance in the distance by which the printing sheet might otherwise be fed too far in reverse caused by manufacturing defects of supply rollers 21 and the drive system, and high quality printing can be provided.

Finally, ink is ejected onto printing sheet P to perform printing, after which printing sheet P is discharged through discharge rollers 71 and 72 and discharge portion 80 onto the discharge tray 81.

Accordingly, by providing a printer which includes a feed roller for feeding a printing sheet, pinch rollers for pressing the printing sheet against the feed roller, and sheet guides for guiding the printing sheet to the point of contact between the feed roller and the pinch rollers, the sheet is guided by the sheet guides and is fed while being pressed between the feed roller and the pinch rollers. By providing sheet guides with ends which contact the feed roller near the point of contact between the feed roller and the pinch rollers, the printing sheet is guided smoothly toward the contact portion between said rollers. Further, by forcing the sheet guide ends toward the feed roller with the forcing member, and by providing control rollers rotatably attached to the sheet guides in contact with the feed roller, the contact force at the end of the sheet guide relative to the feed roller is controlled by the control rollers. Therefore, even if the individual items have manufacturing defects, any resultant variance in the contact force between the ends of the sheet guides and the feed roller is minimized. Accordingly, the abrasive effect between the feed roller and the ends of the sheet guides is minimal, and the feed roller can be rotated smoothly both forward and in reverse.

Moreover; even where the leading end of the printing sheet is curled toward the feed roller, the leading end of the sheet is prevented from sticking to, or is separated from, the feed roller when rotated in reverse. In particular, as the feed roller and the pinch rollers rotate in reverse to align the leading edge of the printing sheet by passing it in reverse through the point of contact between the feed roller and the pinch rollers, the leading edge of the printing sheet is separated from the feed roller by the ends of the sheet guides which contact the feed roller in the vicinity of the point of contact between the feed roller and the pinch rollers. As a result, a relatively accurate leading condition can be obtained by the succeeding forward rotation of the feed roller.

Finally, by rotatably supporting the sheet guides on the frame of the printer by a shaft that can be moved toward the feed roller, and by providing the rotational axis of the shaft, the rotational axis of the feed roller, and the rotational axes of the control rollers substantially in a line, any variance in the contact force exerted by the sheet guides to the feed roller can be reduced even where the individual components have manufacturing defects, and a particular, desired contact force can therefore be easily obtained and maintained.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A printer for printing onto a sheet regardless of any curl in the sheet comprising:

a feed roller for feeding a sheet;

at least one pinch roller positioned on a first side of said sheet for pressing said sheet against said feed roller at a contact point;

at least one guide positioned on a second side of said sheet having an end which contacts said feed roller in a vicinity of said contact point so as to guide said sheet toward said point of contact;

a biasing member for biasing said end of said at least one guide against said feed roller; and at least one control roller rotatably attached to said at least one guide for controlling a contact force exerted by said end of said at least one guide against said feed roller.

2. The printer of claim 1, wherein said at least one guide includes a shaft, said shaft being rotatably and slidably mounted within said printer for moving toward said feed roller.

3. The printer of claim 2, wherein a rotational axis of said shaft, a rotational axis of said feed roller, and a rotational axis of said at least one control roller are provided substantially in a line.

4. The printer of claim 1, wherein a leading end of said sheet is passed through said contact point, and said feed roller and said at least one pinch roller are first rotated in reverse to pass said leading end through said point of contact in a reverse direction, and are then rotated forward in order to feed said sheet.

5. The printer of claim 1, wherein the biasing member is a spring.

6. The printer of claim 1, wherein said control roller contacts said feed roller to control the force applied to said feed roller adjacent said contact point.

7. A printer for printing onto a sheet regardless of any curl in the sheet comprising:

a feed roller for feeding a sheet;

at least one pinch roller positioned on a first side of said sheet for pressing said sheet against said feed roller at a contact point;

at least one guide positioned on a second side of said sheet having an end which contacts said feed roller in a vicinity of said contact point so as to guide said sheet toward said point of contact, said at least one guide including a shaft, said shaft being rotatably and slidably mounted within said printer for moving toward said feed roller;

a biasing member for biasing said end of said at least one guide against said feed roller; and at least one control roller rotatably attached to said at least one guide for controlling a contact force exerted by said end of said at least one guide against said feed roller, wherein a rotational axis of said shaft, a rotational axis of said feed roller, and a rotational axis of said at least one control roller are provided substantially in a line, and wherein said control roller contacts said feed roller to control the contact force applied to said feed roller adjacent said contact point.

8. The printer of claim 7, wherein the biasing member is a spring.

* * * * *